US006120138A

United States Patent [19]

Xiao et al.

[11] Patent Number: 6,120,138

[45] Date of Patent: Sep. 19, 2000

[54] REFILL ASSEMBLY FOR PRINTER INK CARTRIDGES

[75] Inventors: Qing Guo Xiao; Xiao Dong Hu, both of Zhu Hai, China

[73] Assignee: Hana Company Limited, Chai Wan, The Hong Kong Special Administrative Region of the People's Republic of China

[21] Appl. No.: 09/075,925

[22] Filed: May 12, 1998

[30] Foreign Application Priority Data

May 12, 1997 [CN] China ..... 97216524

[51] Int. Cl.[7] ..... B41J 2/175

[52] U.S. Cl. ..... 347/85

[58] Field of Search ..... 347/85, 86, 87; 128/236

[56] References Cited

U.S. PATENT DOCUMENTS

| | | | |
|---|---|---|---|
| 4,346,708 | 8/1982 | LeVeen et al. | 128/236 |
| 5,495,877 | 3/1996 | Schwenk et al. | 141/370 |
| 5,704,403 | 1/1998 | Schwenk et al. | 141/18 |

FOREIGN PATENT DOCUMENTS

| | | | |
|---|---|---|---|
| 0755795 | 1/1997 | European Pat. Off. . | |
| 0707970 | 4/1998 | European Pat. Off. . | |
| 6106729 | 4/1994 | Japan | 347/85 |
| 2307450 | 5/1997 | United Kingdom . | |
| WO9715449 | 5/1997 | WIPO . | |
| WO9822290 | 5/1998 | WIPO . | |

OTHER PUBLICATIONS

Patent Abstracts of Japan, vol. 097, No. 006, Jun. 30, 1997 for JP 09–039263 (Canon, Inc.) published on Feb. 2, 1997.

*Primary Examiner*—N. Le
*Assistant Examiner*—Anh T. N. Vo
*Attorney, Agent, or Firm*—Leydig, Voit & Mayer, Ltd.

[57] ABSTRACT

A refill assembly for refilling a printer ink cartridge having a bleed hole. The assembly includes a base unit for containing and holding the cartridge and an ink supply for containing ink for refilling the cartridge. The ink supply includes a nozzle and piston in a cylinder for dispensing the ink through the nozzle. The base unit includes an adaptor having a first end for joining with the nozzle and a second end for joining to the bleed hole by pressing against a surface of the cartridge around the bleed hole, enabling a flow of ink from the ink supply into the cartridge.

11 Claims, 6 Drawing Sheets

REFILL ASSEMBLY FOR PRINTER INK CARTRIDGES

BACKGROUND OF THE INVENTION

Printer ink cartridges are relatively expensive consumable accessories and their replacement is also damaging to the environment. Certain ink refill kits are known to exist on the market, but they are only designed for certain types of cartridges and particularly for those cartridges which have a penetratable hole. Printer manufacturers redesign their cartridges to omit such a hole, which prevents the use of the existing refill kits.

The invention seeks to introduce an improved refill assembly to solve this problem.

SUMMARY OF THE INVENTION

According to the invention, there is provided a refill assembly for refilling a printer ink cartridge having a bleed hole, which assembly comprises a base unit for holding the cartridge in position and an ink supply containing ink for refilling the cartridge, wherein the ink supply includes an outlet and dispensing means for dispensing the ink through the outlet, and the base unit includes an adaptor having a first end for joining with the outlet and a second end for joining to the bleed hole by pressing against a surface of the cartridge around the bleed hole, thereby enabling a flow of ink from the ink supply into the cartridge.

Preferably, a seal is provided at the second end of the adaptor for pressing against the surface around the bleed hole.

More preferably, the seal is tubular and has an end which covers a rim of the second end of the adaptor.

In a preferred embodiment, the base unit has a hollow body including by a base and a lid, the lid incorporating the adaptor such that closing of the lid will cause the joining of the second end of the adaptor to the bleed hole.

More preferably, the lid includes a recess for receiving a part including the outlet of, and thus locating, the ink supply, the adaptor being provided at the bottom of the recess.

It is preferred that the outlet of the ink supply is a nozzle for press-fitting into the first end of the adaptor and thus joining therewith.

In a preferred construction, the ink supply has a cylindrical body which contains the ink and provides the outlet at one end, and the dispensing means comprises a piston inside the body and a plunger for sliding the piston along the body.

Preferably, the plunger is threaded for rotation to slide the piston.

More preferably, the dispensing means include a support having a threaded hole through which the plunger is to threadedly engage for rotation to slide the piston.

It is further preferred that the support is releasably attached to the opposite end of the body through a bayonet connection.

In a preferred arrangement, the plunger releasably engages a rear side of the piston for pushing it forwards, and a spring is provided on the forward side of the piston for returning the piston upon withdrawal of the plunger.

Advantageously, the body contains a layer of air between the ink and the piston for cushioning.

BRIEF DESCRIPTION OF DRAWINGS

The invention will now be more particularly described, by way of example only, with reference to the accompanying drawings, in which:

FIG. 4 is a left side perspective view corresponding to

FIG. 3, showing an ink cartridge placed inside;

DETAILED DESCRIPTION OF PREFERRED EMBODIMENTS

Figure 1:
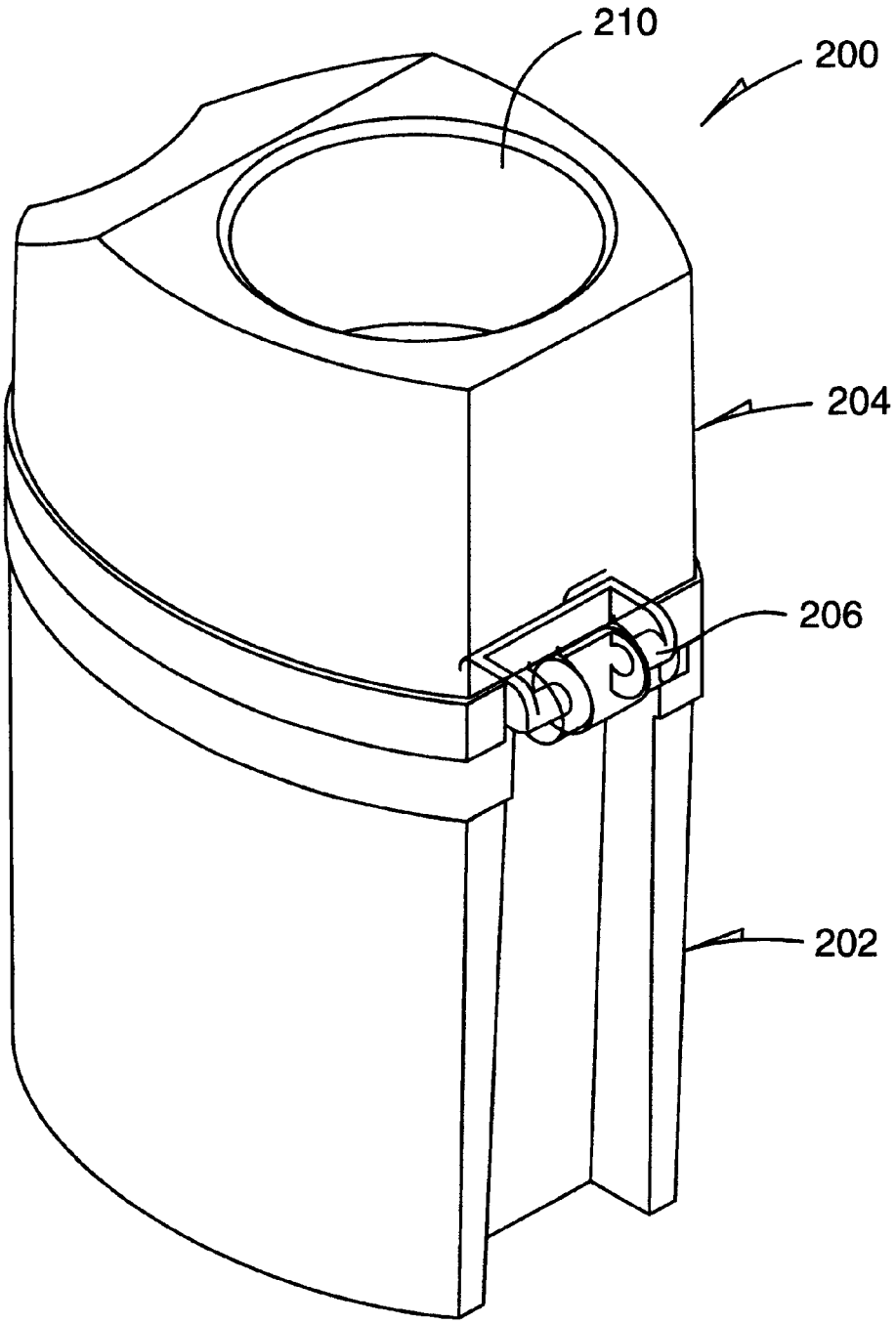
FIG. 1 is a rear perspective view of a base unit of an embodiment of a refill assembly in accordance with the invention.
Figure 2:
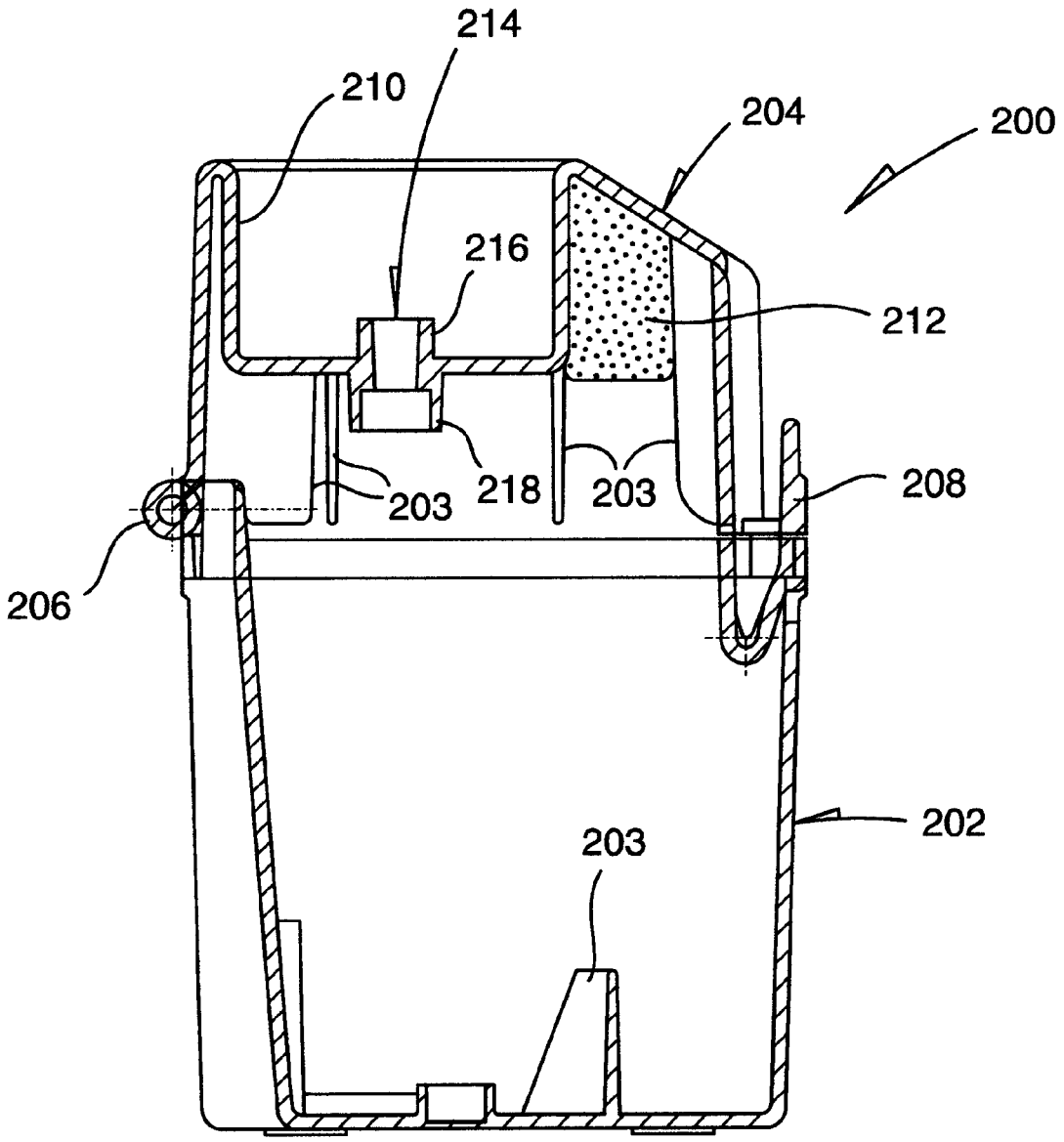
FIG. 2 is a cross-sectional left side view of the base unit of FIG. 1.
Figure 3:
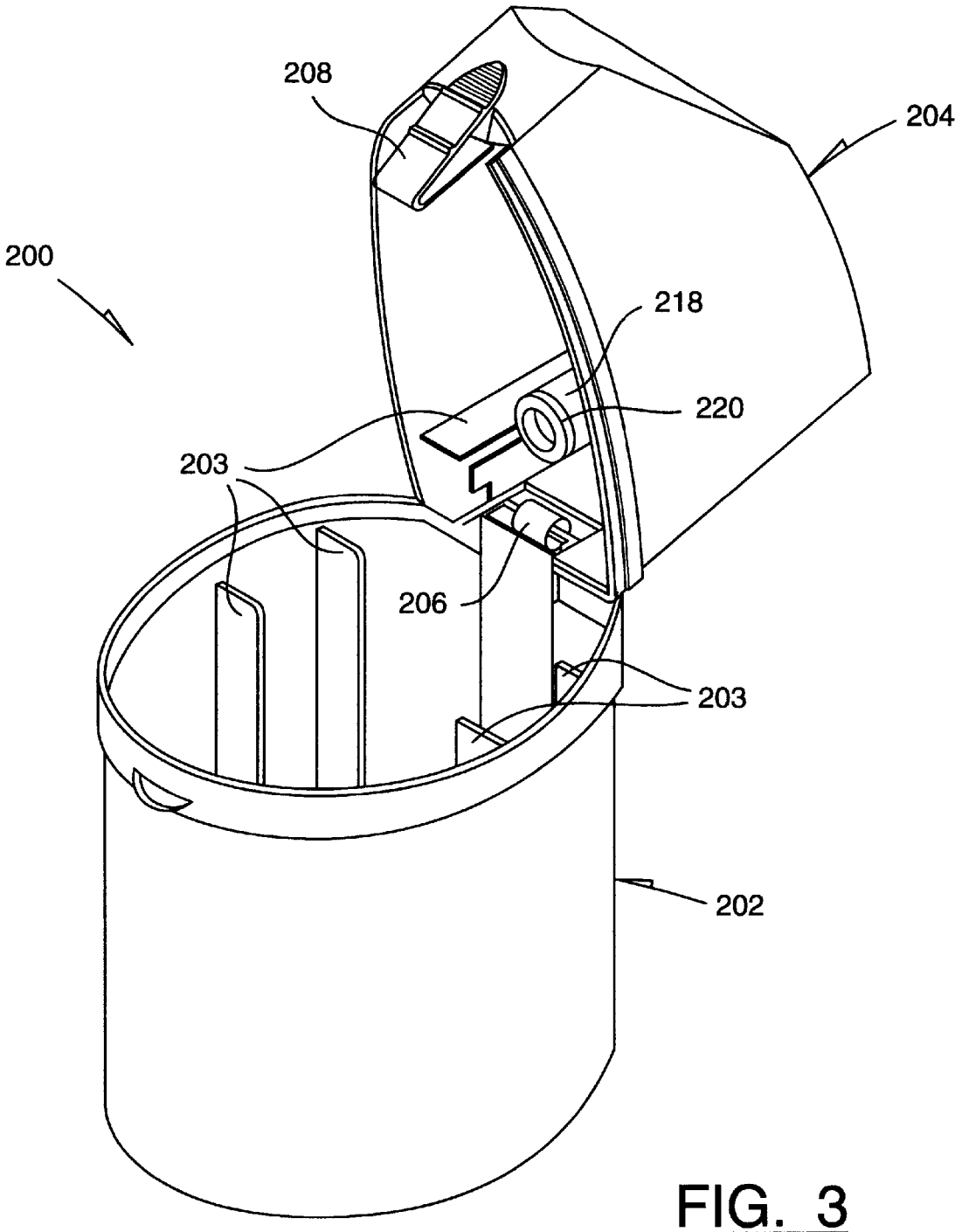
FIG. 3 is a right side perspective view of the base unit of FIG. 1 in an open condition.
Figure 4:
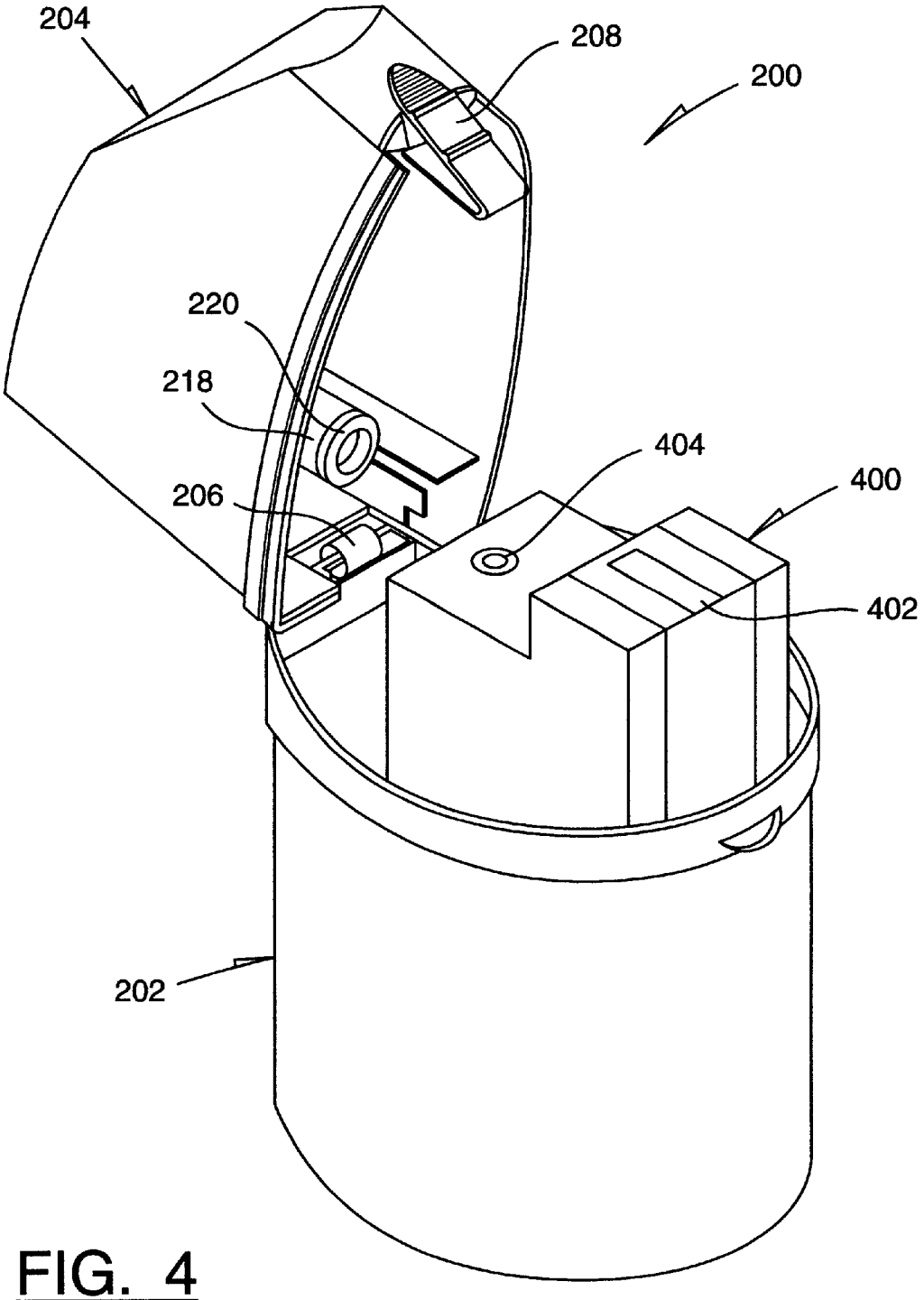
Figure 5:
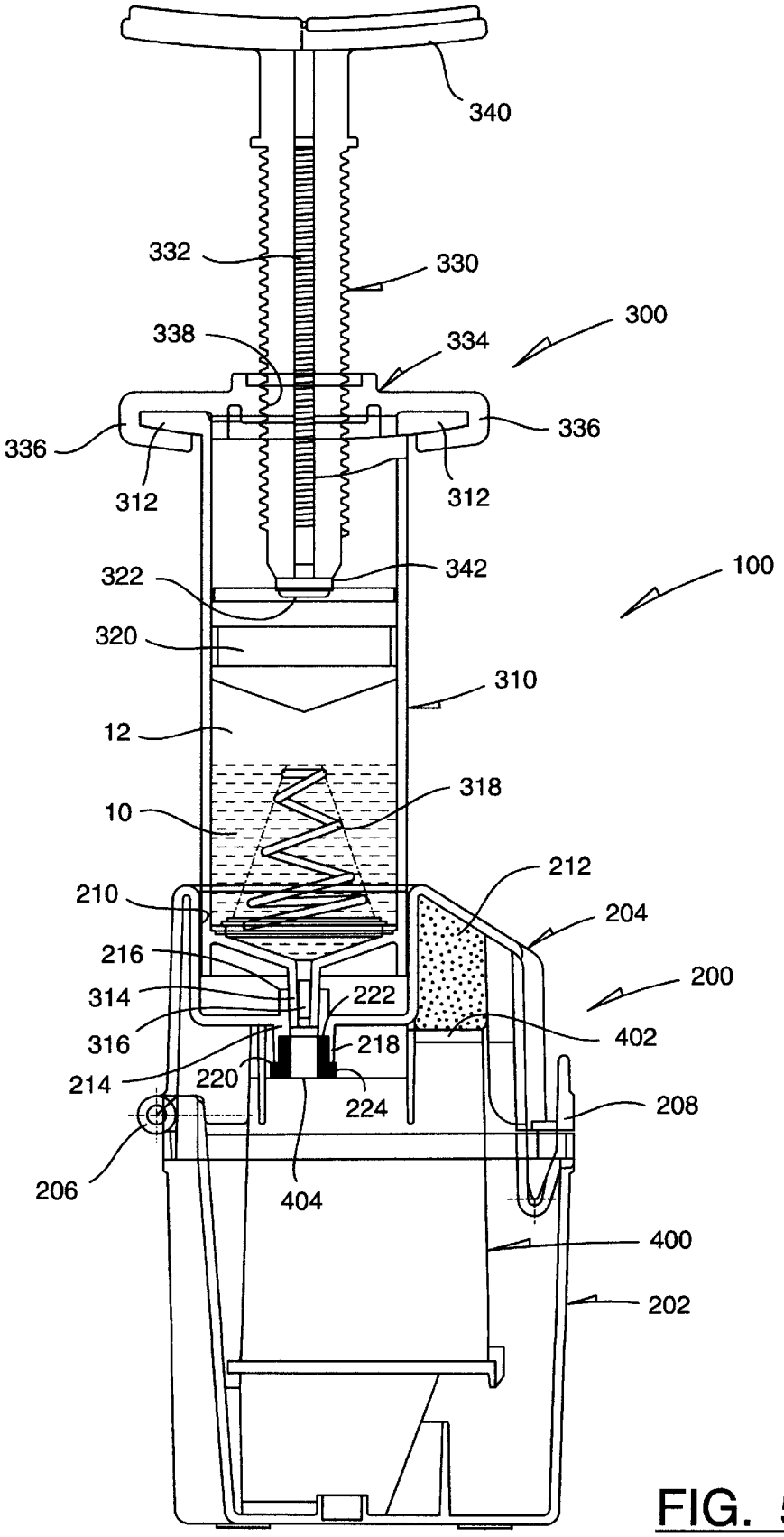
FIG. 5 is a cross-sectional left side view showing the base unit of FIG. 4 closed to fully enclose the cartridge, and the use of an ink supply, which forms the other part of the refill assembly, atop the base unit.

Referring firstly to FIGS. 1 to 5 of the drawings, there is shown a refill assembly 100 embodying the invention for refilling a computer printer ink cartridge 400 with ink 10, which assembly 100 comprises a base unit 200 for containing the cartridge 400 and an ink supply 300 for use on the base unit 200. The base unit 200 has a plastic body including a base 202 and a lid 204 which is connected to the base 202 by means of a hinge 206 on the rear side. A latch 208 is used on the front side to lock the lid 204 closed. The lid 204 includes a cylindrical top recess 210 for locating the ink supply 300 in use. Inner sides of the walls of the base 202 and lid 204 include fins 203 for locating the cartridge 400 in position. A piece of sponge 212 is held within the lid 204 at a position close to the recess 210 as shown.

The recess 210 has a central bottom hole which has a rim portion extending upwards and downwards to form an integral tubular adaptor 214. The adaptor 214 has a top end 216 and a bottom end 218, the bottom end 218 being fitted with a tubular rubber seal 220. The seal 220 has an upper end 222 press-fit into the adaptor bottom end 218 and a lower end 224 which is radially enlarged to cover the rim of the adaptor bottom end 218.

The ink supply 300 has an upright cylindrical plastic case 310 containing the ink 10 with an upper layer of air 12. It further includes a piston 320 slidable along the axis of the case 310 and a plunger 330 for moving the piston 320 downwards. The case 310 has a top end having a pair of opposite side flanges 312 and a bottom end formed with a tubular nozzle 314 for dispensing the ink 10. The nozzle 314 is fitted with a flow control plug 316 to control the flow of ink. A conical coil spring 318 is located inside the bottom end of the case 310, at a position close to the nozzle 314, for self-returning the piston 320 upon withdrawal of the plunger 330. The piston 320 has, on its upper side, a central recess 322.

The plunger 330 has a vertical X-sectioned shank 332 which is screw-threaded for threaded engagement with an apertured cap 334 attached to the top end of the case 310. The cap 334 has a pair of opposite side hooks 336 in releasable engagement with respective side flanges 312 of the case 310 through a bayonet connection. The cap 334 further includes a screw-threaded central hole 338, to which the shank 332 is threadedly engaged for gradual entry into the case 310 like a metering screw. The shank 332 has a T-shaped upper end 340 to facilitate manual rotation and a lower end 342 inside the case 310 for releasably engaging or abutting the piston 320 at the recess 322.

The ink cartridge 400 has, on its bottom side, a print head 402 and also a bleed hole 404 which allows air to enter while the ink is being used. In order to avoid leakage of ink, the bleed hole 404 is provided with a tortuous or maze-like path as well as a one-way ball valve. The subject refill assembly 100 is designed to enable refilling of the cartridge 400 with ink through the bleed hole 404.

To prepare for ink refilling, the cartridge 400 is placed upside down into the base 202 of the base unit 200, with the lid 204 then closed and locked to fully enclose and hold the cartridge 400 in position. Pivoting down of the lid 204 causes the seal 220 at the lower end 218 of the adaptor 214 to press against the surface of the cartridge 400 around the bleed hole 404, thereby joining the adaptor 214 to the bleed hole 404 for communication. At the same time, the sponge 212 is brought against the print head 402. Afterwards, the ink supply 300 is located atop the base unit 200 by having the bottom end of its case 310 inserted into the base unit recess 210. In doing so, the nozzle 314 of the ink supply 300 is press-fitted into and thus joined to the upper end 216 of the adaptor 214 for communication. Another rubber seal, such as a seal ring, may be used at the adaptor upper end 216 for leak prevention. Alternatively, the nozzle 314 may be made sufficiently long to reach against the upper end of 222 of the existing seal 220.

The refill assembly 100 is now properly set up. Clockwise manual rotation of the ink supply plunger 330 will advance the piston 320 gradually downwards, thereby pressing the ink 10 to flow out through the nozzle 314 and then via the adaptor 214 into the cartridge 400 through the bleed hole 404. The layer of air 12 above the ink 10 acts as a cushion to smooth the pressure applied by the piston 320. When the piston 320 reaches the bottom end of the case 310, the cartridge 400 will be fully refilled with ink. Any excessive ink will leak out through the print head 402 and be absorbed by the sponge 212.

The plunger 330 should stay for about thirty seconds until the ink pressure settles. It is then unwound to allow the piston 320 to be self-returned by the coil spring 318. For this type of ink cartridge 400, which contains a spring-loaded air bag to take up the internal space left behind by the ink used, subsequent to ink refilling, it is normally necessary to expand the air bag slightly, for balance of pressure, by introducing some air into the air bag via a vent hole by means of a rubber bulb, as generally known in the art.

Figure 6:
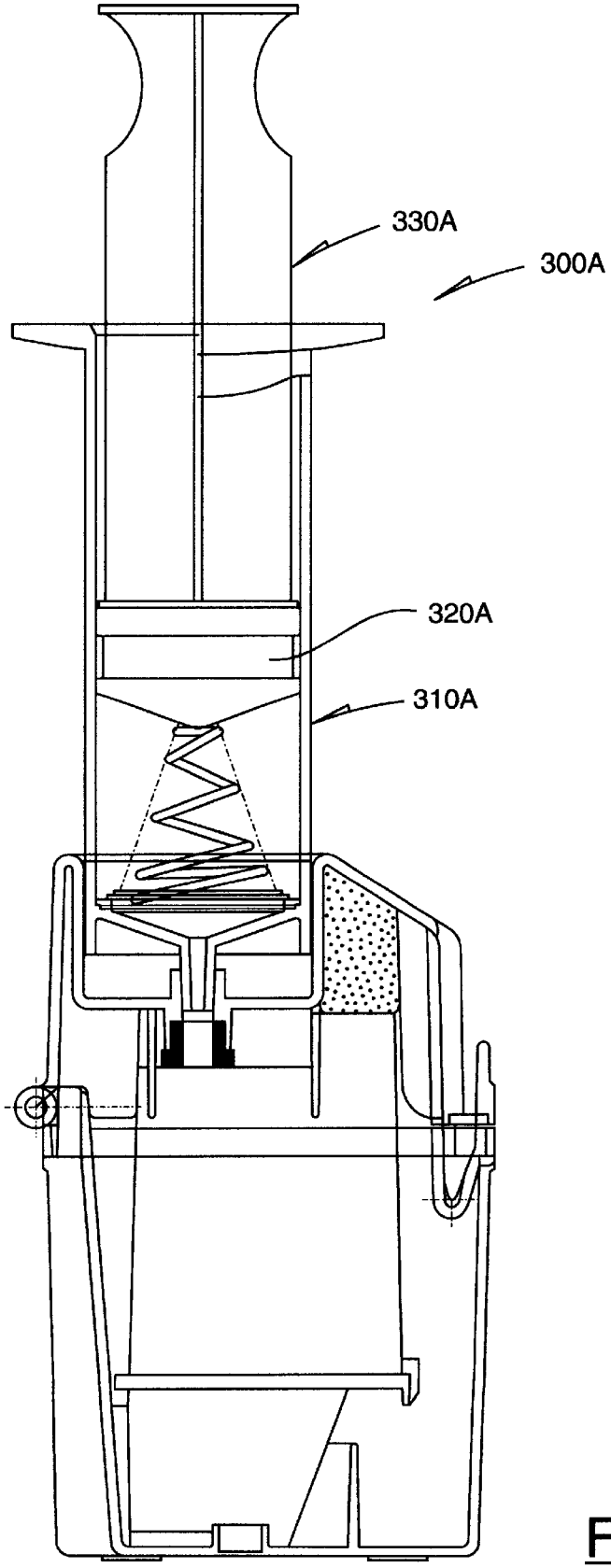
FIG. 6 is a cross-sectional left side view similar to FIG. 5, which shows the use of a different ink supply.

Reference is finally made to FIG. 6 of the drawings, which shows the use of a slightly different ink supply 300A, with like parts designated by like reference numerals having a suffix "A". This ink supply 300A has the same case 310A and makes use of the same piston 320A but a plunger 330A which is not screw-threaded and does not operate in a threading action. The plunger 330A is movable straight along the axis of the case 310A, as in the case of an ordinary syringe.

The invention has been given by way of example only, and various other modifications of and/or alterations to the described embodiment may be made by persons skilled in the art without departing from the scope of the invention as specified in the appended claims.

What is claimed is:

1. A refill assembly for refilling a printer ink cartridge having a bleed hole, the refill assembly comprising:

a base unit for holding a printer ink cartridge and for engaging an ink supply containing ink for refilling the cartridge, the ink supply including a cylindrical body for containing ink and having an outlet at one end, a piston inside the cylindrical body, a plunger for sliding the piston along the cylindrical body, and a spring located inside the cylindrical body between the outlet and the piston for returning the piston upon release of pressure on the plunger, and the base unit including an adaptor having a first end for joining with the outlet and a second end for joining to the bleed hole upon pressing of the adaptor against a surface of the cartridge around the bleed hole, thereby enabling a flow of ink from the ink supply into the cartridge.

2. The refill assembly as claimed in claim 1, including a seal at the second end of the adaptor for pressing against the surface around the bleed hole.

3. A refill assembly as claimed in claim 2, wherein the seal is tubular and has an end which covers a rim of the second end of the adaptor.

4. The refill assembly as claimed in claim 1, wherein the base unit has a hollow body including a base and a lid hinged to the base for opening and closing the hollow body, the lid incorporating the adaptor such that closing of the lid causes joining of the second end of the adaptor to the bleed hole.

5. The refill assembly as claimed in claim 4, wherein the lid includes a recess for receiving the outlet of the ink supply, thus locating the ink supply, the adaptor being located at the recess.

6. The refill assembly as claimed in claim 1, wherein the outlet of the ink supply is of a nozzle for press-fitting into the first end of the adaptor.

7. The refill assembly as claimed in claim 1, wherein the plunger is threaded and rotates to side the piston along the body.

8. The refill assembly as claimed in claim 7, wherein the ink supply includes a support having a threaded hole threadedly engaged by the plunger for rotation of the plunger to slide the piston along the body.

9. The refill assembly as claimed in claim 8, wherein the support is releasably attached to the body through a bayonet connection.

10. The refill assembly as claimed in claim 1, wherein the plunger releasably engages a rear side of the piston for pushing the piston.

11. The refill assembly as claimed in claim 1, wherein the body contains ink and air between the ink and the piston for cushioning.

* * * * *